US008657213B2

(12) United States Patent
Sakata et al.

(10) Patent No.: US 8,657,213 B2
(45) Date of Patent: Feb. 25, 2014

(54) FUEL INJECTION VALVE

(75) Inventors: Yukitaka Sakata, Chiyoda-ku (JP); Naoya Hashii, Chiyoda-ku (JP); Tsuyoshi Munezane, Chiyoda-ku (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 798 days.

(21) Appl. No.: 12/906,692

(22) Filed: Oct. 18, 2010

(65) Prior Publication Data

US 2011/0253812 A1 Oct. 20, 2011

(30) Foreign Application Priority Data

Apr. 16, 2010 (JP) ..... 2010-094953

(51) Int. Cl.

| | |
|---|---|
| ***F02M 61/00*** | (2006.01) |
| ***F02M 59/00*** | (2006.01) |
| ***F02M 63/00*** | (2006.01) |
| ***B05B 1/00*** | (2006.01) |

(52) U.S. Cl.
USPC ..... 239/533.12; 239/533.2; 239/596

(58) Field of Classification Search
USPC ..... 239/533.2, 533.12, 596
See application file for complete search history.

(56) References Cited

U.S. PATENT DOCUMENTS

| | | | | |
|---|---|---|---|---|
| 4,890,794 | A * | 1/1990 | Imafuku et al. | 239/533.12 |
| 6,708,904 | B2 * | 3/2004 | Itatsu | 239/533.12 |
| 6,848,636 | B2 * | 2/2005 | Munezane et al. | 239/533.12 |
| 7,198,207 | B2 * | 4/2007 | Goenka et al. | 239/533.12 |
| 8,231,069 | B2 * | 7/2012 | Matsumura et al. | 239/533.12 |
| 8,313,048 | B2 * | 11/2012 | Krause | 239/533.12 |
| 2004/0074996 | A1 | 4/2004 | Munezane et al. | |

FOREIGN PATENT DOCUMENTS

| | | | |
|---|---|---|---|
| JP | 2003-336563 | A | 11/2003 |
| JP | 2004-137931 | A | 5/2004 |
| JP | 2004-204806 | A | 7/2004 |
| JP | 2006-132434 | A | 5/2006 |
| JP | 2008-231928 | A | 2/2008 |
| JP | 2008-184977 | A | 8/2008 |
| JP | 2009-197682 | A | 3/2009 |

OTHER PUBLICATIONS

Japanese Office Action dated May 15, 2012, issued in corresponding Japanese Patent Application No. 2010-094953.

* cited by examiner

*Primary Examiner* — Ryan Reis
(74) *Attorney, Agent, or Firm* — Sughrue Mion, PLLC

(57) ABSTRACT

A plate convex is formed on the upstream side of the injection hole plate and a plate concave is formed on the downstream side of the injection hole plate so as to form a pair together, a minimum of one set of the plate convexes and the plate concaves are formed, and the injection holes are arranged so that the radial centerline which connects the centerline of the plate convex from the axial center of the fuel injection valve does not overlap the center of the injection hole on an upstream flat surface of the injection hole plate, and the plate convex is arranged so as to straddle the injection hole on the upstream flat surface of the injection hole plate, and the top surface of the plate convex.

18 Claims, 10 Drawing Sheets

SEEN FROM ARROW J

SEEN FROM ARROW K

SEEN FROM ARROW M

SEEN FROM ARROW N

FUEL INJECTION VALVE

BACKGROUND OF THE INVENTION

1. Field of the Invention

The present invention relates mainly to an electromagnetic fuel injection valve to be used for a fuel supply system of an internal combustion engine, and particularly, to the promotion of atomization or suppression of spray shape variations in the spray characteristics of the fuel injection valve, and improvement in the flow rate accuracy in flow rate characteristics or suppression of the amount of change to the ambient pressure change.

2. Description of the Background Art

In recent years, while regulation of the exhaust gases of an automobile or the like has tightened, improvement in the atomization of fuel spray injected from the fuel injection valve is required. With respect to the atomization of the fuel spray, various kinds of deliberation have already been made up to this point.

For example, a fuel injection device (see JP-A-2003-336563) is suggested in which an individual guide passage is provided in every injection hole, fuel is rectified and accelerated by this guide passage and flows into a swirl chamber, and the fuel is injected as a hollow conical spray from an injection hole plate outlet while the fuel forms a swirling flow in the swirl chamber and swirls within the injection hole, thereby promoting atomization.

However, since the above fuel injection device of the above JP-A-2003-336563 has an individual guide passage for every injection hole, and is structured such that the flow rectified and accelerated by the guide passage flows into the swirl chamber, there are the following problems.

A portion of the fuel within a dead volume may be decompressed and boil, and may become a vapor-liquid two-phase flow under high-temperature negative pressure. However, reduction of the flow rate when the vapor-liquid two-phase flow passes through a narrow flow passage is large, and the fuel injection device of JP-A-2003-336563 has a flow passage configuration in which a throttle to be a guide passage from the downstream of a seat to an injection hole is provided. Therefore, there is a problem in which changes in the flow characteristics (static flow rate and dynamic flow rate) accompanying changes in the temperature, ambient pressure, etc. are increased.

Additionally, since the velocity of flow which flows into the each swirl chamber depends on the shape of the guide passage, there is a problem in that the influence that shape variations of the guide passage has on deviation of injection quantity from each injection hole is great, a high-precision shape is required as the guide passage, and the manufacturing costs increase. If the deviation of injection quantity is great, the spray shape varies, and when the fuel is injected into the engine, the amount of adhesion to each part of the engine or the distribution of an air-fuel mixture varies. Therefore, there is a possibility that an increase in the amount of exhaust gas or fluctuation of engine rotation by combustion variation is caused.

In order to make a liquid film of the fuel thin and to atomize the fuel spray, it is necessary to apply a large swirling force to the fuel within the injection hole. Additionally, in order to strengthen the swirling force within the swirl chamber it is necessary to increase the offset between an injection hole inlet portion and the fuel passage while making the swirl chamber small, and the ratio of the depth/width of the fuel passage becomes large. For this reason, there is a problem in that working of the fuel passage becomes difficult, and in a case where the fuel passage is formed by a press, the lifespan of the die becomes short and the manufacturing costs increase.

In a case where a number of injection holes are formed for further atomization of the fuel spray, the diameter of each injection hole becomes small, and the fuel passage becomes narrow accordingly. Therefore, there is a problem in that working of the fuel passage becomes difficult, and in a case where the fuel passage is formed by a press, the lifespan of the die becomes short and the manufacturing costs increase.

SUMMARY OF INVENTION

On the other hand, in the fuel injection valve related to the invention, a plate convex is formed on the upstream side of the injection hole plate and a plate concave is formed on the downstream side of the injection hole plate so as to form a pair together, a minimum of one set of the plate convexes and the plate concaves are formed, and the injection holes are arranged so that a radial centerline which connects the centerline of the plate convex from the axial center of the fuel injection valve does not overlap the center of the injection hole on an upstream flat surface of the injection hole plate, and the plate convex is arranged so as to straddle the injection hole on the upstream flat surface of the injection hole plate, and the top surface of the plate convex.

The present invention is constructed such that the fuel flow along the valve seat surface swirls around the projection provided in the plate, and flows into the injection hole after passing through the valve opening portion to generate a swirling flow. Thereby, the fuel flow swirls within the injection hole while being pushed against the injection hole inner wall. In the present invention, as fuel passing through the valve seat opening portion is rectified by swirling around the plate convex to strengthen a swirling flow, there is an advantage that the centrifugal force within the injection hole is large, and that a hollow liquid film to be sprayed can be made thinner.

In the present invention, for example, even if a portion of the fuel is decompressed and boils, and a vapor-liquid two-phase flow is generated within the dead volume, since the passage area within the dead volume is large, reduction of flow rate by the vapor-liquid two-phase flow is small.

Additionally, since vapor and liquid are separated by the swirling flow within the injection hole and bubbles are gathered within the central portion of the injection hole, it is possible to suppress clogging of the bubbles within the injection hole, and to make small changes in flow characteristic (a static flow rate and a dynamic flow rate) accompanying an atmosphere change.

Additionally, in the present invention, there is no complicated guide passage as shown in JP-A-2003-336563, and the plate convex and the plate concave have simple shapes. Therefore, high-precision working is easy, and it is possible to suppress variation of injection quantity at a low manufacturing cost.

The foregoing and other objects, features, aspects, and advantages of the present invention will become more apparent from the following detailed description of the present invention when taken in conjunction with the accompanying drawings.

DETAILED DESCRIPTION OF THE PREFERRED EMBODIMENTS

Embodiment 1

Figure 1:
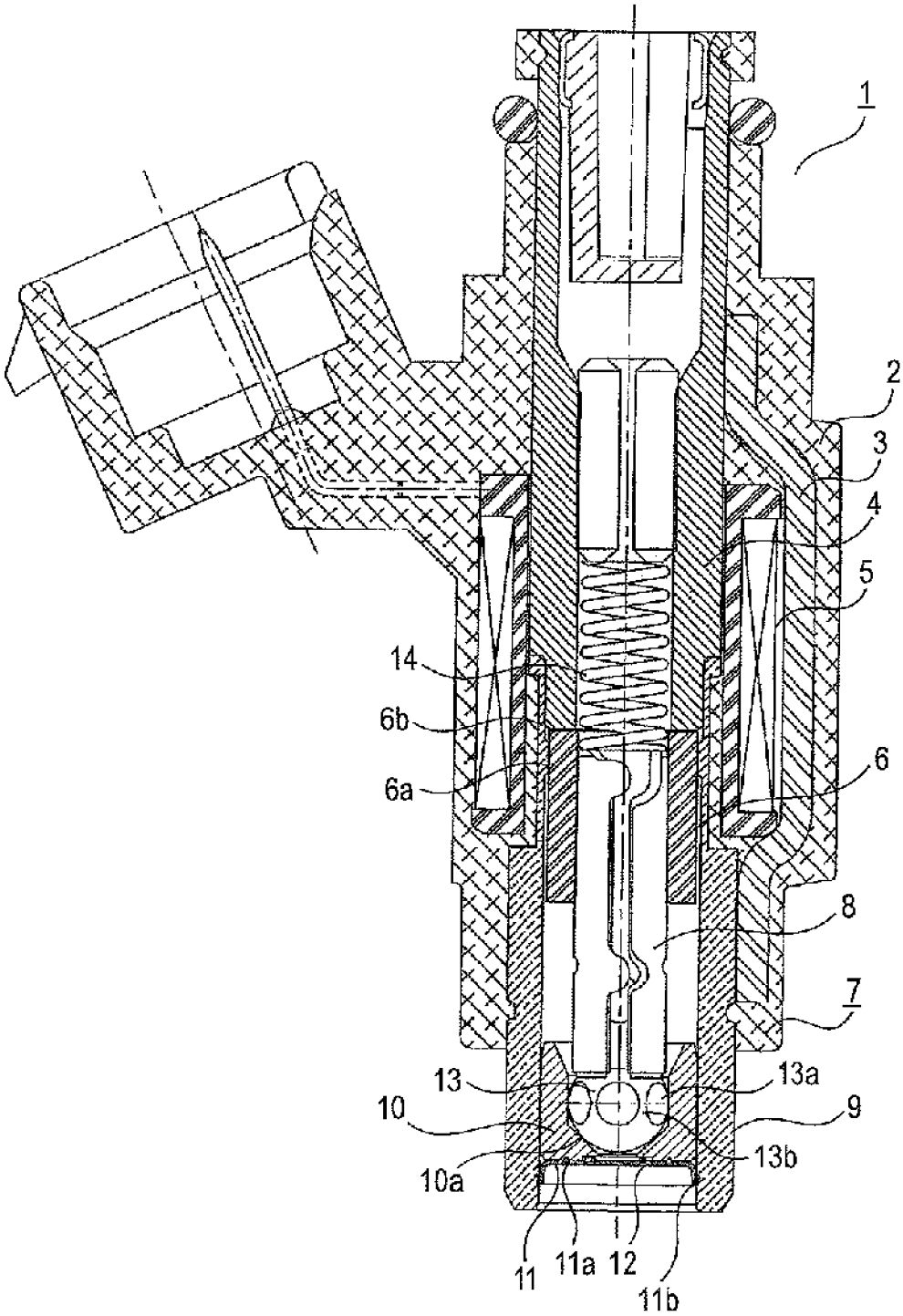
FIG. 1 is a view showing a cross-section of a fuel injection valve of Embodiments 1-10 of the invention.
Figure 2:
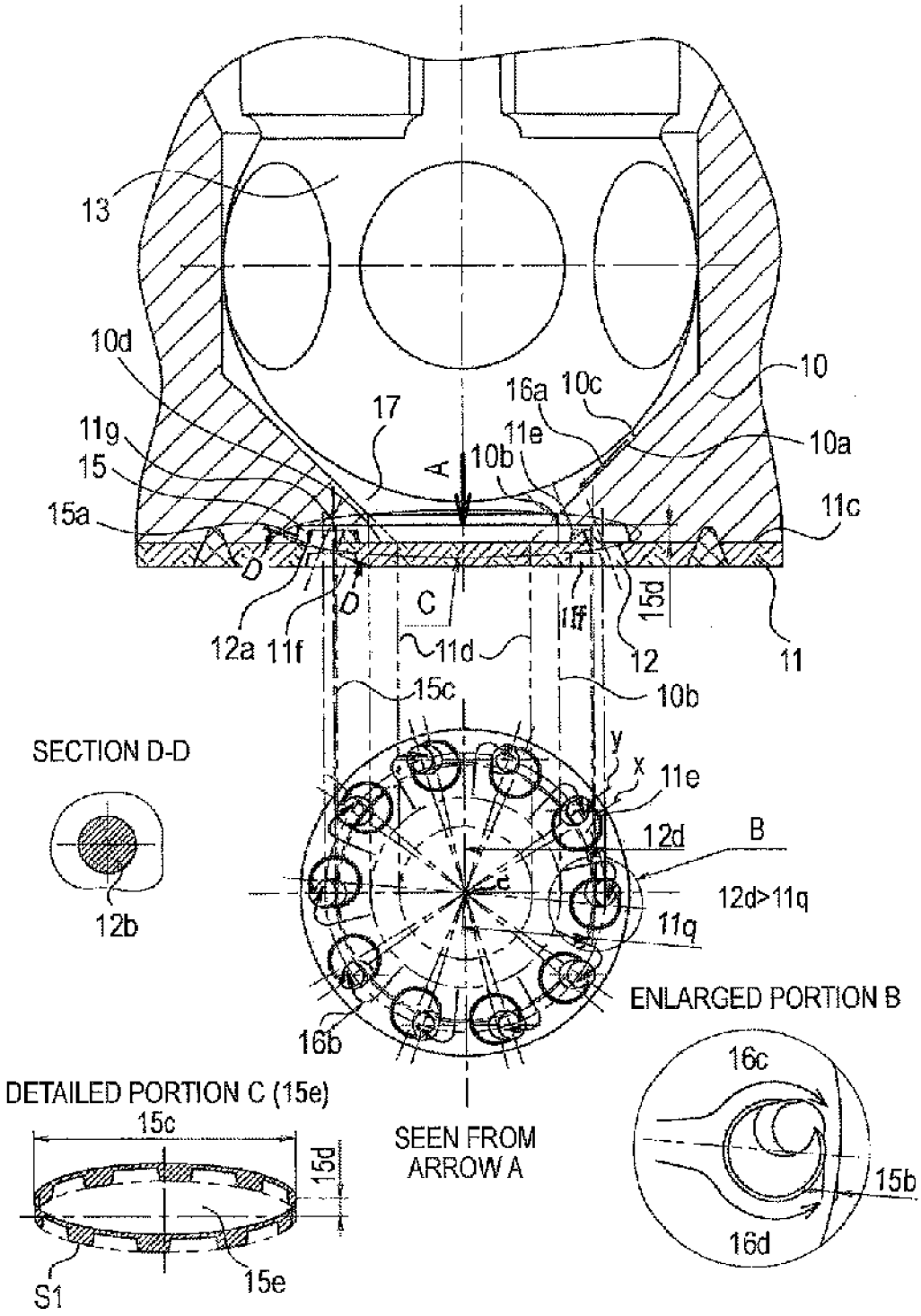
FIG. 2 is a view showing a detailed cross-section of a tip portion of the fuel injection valve of Embodiment 1.

A sectional view of a fuel injection valve of Embodiment 1 of this invention is shown in FIGS. 1 and 2. In the drawing, reference numeral 1 designates a fuel injection valve, reference numeral 2 designates a solenoid device, reference numeral 3 designates a housing which is a yoke portion of a magnetic circuit, reference numeral 4 designates a core which is a fixed core portion of the magnetic circuit, reference numeral 5 designates a coil, reference numeral 6 designates an armature which is a movable core portion of the magnetic circuit, and reference numeral 7 designates a valve device, and the valve device 7 is constituted by a valve body 8, a main valve body 9, and a valve seat 10. The main valve body 9 is welded after being press-fitted into an external diameter portion of the core 4. The armature 6 is welded after being press-fitted into the valve body 8. The valve seat 10 is inserted into the main valve body 9 in a state where an injection hole plate 11 is combined with the downstream side of the valve seat by a welded portion 11*a*, and is then combined with the main valve body by a welded portion 11*b*. The injection hole plate 11 is provided with a plurality of injection holes 12 which penetrates in the plate thickness direction.

Next, the operation will be described. When an actuating signal is sent to a driving circuit (not shown) of the fuel injection valve 1 from a control device of an engine, an electric current is applied to the coil 5 of the fuel injection valve 1, a magnetic flux is generated in a magnetic circuit including the armature 6, the core 4, the housing 3, the main valve body 9, and the armature 6, and the armature 6 is attracted to the core 4 side, and when the valve body 8 which is structured integrally with the armature 6 is separated from a valve seat surface 10*a* to form a gap, a fuel passes through the gap between the valve seat surface 10*a* and the valve body 8 from a plurality of grooves 13*a* provided in the tip portion 13 of the valve body 8, and is injected into an engine intake pipe from the plurality of injection holes 12.

Next, when a stop signal of operation is sent to the driving circuit of the fuel injection valve 1 from the control device of the engine, the application of an electric current to the coil 5 is stopped, the magnetic flux of the magnetic circuit is reduced, the gap between the valve body 8 and the valve seat surface 10*a* is closed by a compression spring 14 which pushes the valve body 8 in a valve closing direction, and fuel injection is ended. The valve body 8 which is structured integrally with the armature 6 slides on the main valve body 9 by a guide portion 6*a*, and the tip portion 13 of the valve body 8 slides on the valve seat 10 by a guide portion 13*b*. In a valve-opened state, an armature top surface 6*b* abuts on the bottom surface of the core 4.

In the present embodiment, as shown in FIG. 2, the injection hole plate 11 is arranged so that an extension of the seat surface 10*a* of the valve seat 10 which is reduced in diameter to the downstream side and an upstream flat surface 11*c* of the injection hole plate 11 intersect each other to form one imaginary circle 11*d*.

Thereby, when the valve body is closed, the ratio at which the space formed by the valve seat 10 and the valve seat opening portion 10*b* is occupied by the valve body tip portion 13 increases, and a dead volume 17 (the volume surrounded by the valve body tip portion 13, the valve seat 10, and the injection hole plate 11 when the valve is closed) is reduced that much. Thus, the amount of fuel evaporation within the dead volume 17 under high-temperature negative pressure is low, and changes in flow characteristics (a static flow rate and a dynamic flow rate) accompanying an ambient pressure change can be suppressed.

Additionally, a plurality of injection holes 12 is formed radially outside the valve seat opening portion 10*b* in the injection hole plate 11, and plate convexes 11*e* are formed on the upstream side of the plate and plate concaves 11*f* are formed on the downstream side of the plate, by a number corresponding to the injection holes 12, so as to make pairs. A straight line which connects a plate convex 11*e* and the center of a plate concave 11*f* arranged nearest to the plate convex 11*e* is arranged so as to be vertical to the plate upstream flat surface 11*c* in which the plate convex 11*e* and the plate concave 11*f* are formed. Additionally, a cavity 15 through which the valve seat opening portion 10*b* and the injection holes 12 communicate with each other is provided in a downstream end surface 10*d* of the valve seat 10. In the upstream flat surface 11*c* of the injection hole plate 11, the injection holes 12 are arranged so that a radial centerline X connecting the center of a plate convex 11*e* from the axial center c of the fuel injection valve does not overlap a centerline y of the injection hole 12 (refer to "SEEN FROM ARROW A").

The plate convex 11*e* is arranged so as to straddle the injection hole 12 on the upstream flat surface 11*c* of the injection hole plate 11 and a top surface 11*g* of the plate convex 11*e*. That is, the plate convex 11*e* is arranged in the injection hole plate 11 so that a portion of an injection hole 12 is opened to the upstream flat surface 11*c* of the injection hole plate in the upstream flat surface 11*c* of the injection hole plate 11, and a portion of the same injection hole 12 is opened to the top surface of the plate convex 11*e* even on the top surface 11*g* of the plate convex 11*e*.

Additionally, the injection hole 12 and the plate convex 11*e* which straddles the injection hole 12 are arranged so that the distance 11*q* from the axial center of the fuel injection valve to the center c of the plate convex 11*e* becomes shorter than the distance 12*d* from the axial center of the fuel injection valve to the center c of the injection hole 12.

Thereby, when the valve body is opened, a fuel flow 16*a* from the gap 10*c* between the valve body tip portion 13 and the valve seat surface 10*a* passes through the valve seat opening portion 10*b*, and spreads radially outward from the axial center of the fuel injection valve along the shape of the cavity 15. Thereafter, as the fuel flow swirls around the plate convex 11*e* formed radially outside the valve seat opening portion 10*b*, and flows into the injection hole 12, a swirling flow 16*b* is generated (refer to "SEEN FROM ARROW A" of FIG. 2). At this time, since the gap 15*b* between the plate convex 11*e* and a cavity inner wall 15*a* is narrow, turbulence of flow caused by the collision between a fuel flow 16*c* which has swirled around toward the injection hole 12 and a fuel flow 16*d* which has swirled around toward the opposite side with the radial centerline of the plate convex 11*e* as a borderline is suppressed (refer to "ENLARGED PORTION B" of FIG. 2). Thereby, the fuel flow swirls within the injection hole 12 while being pushed against an injection hole inner wall 12*a*.

Additionally, even if a portion of the fuel is decompressed and boils due to an ambient pressure change, and a vapor-liquid two-phase flow is generated inside the dead volume 17, vapor and liquid are separated by a swirling flow within the Injection hole 12, and are gathered at a portion of the injection hole 12, so that the escape of bubbles within the injection hole can be facilitated, and clogging of the bubbles within the injection hole 12 can be suppressed.

Figure 3:
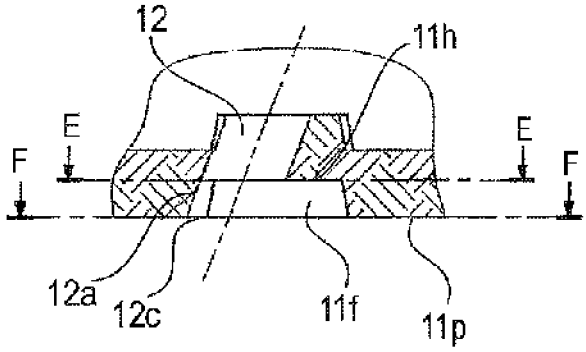
FIG. 3 is a view showing a cross-section of an injection hole portion of the fuel injection valve of Embodiment 1.
Figure 3A:
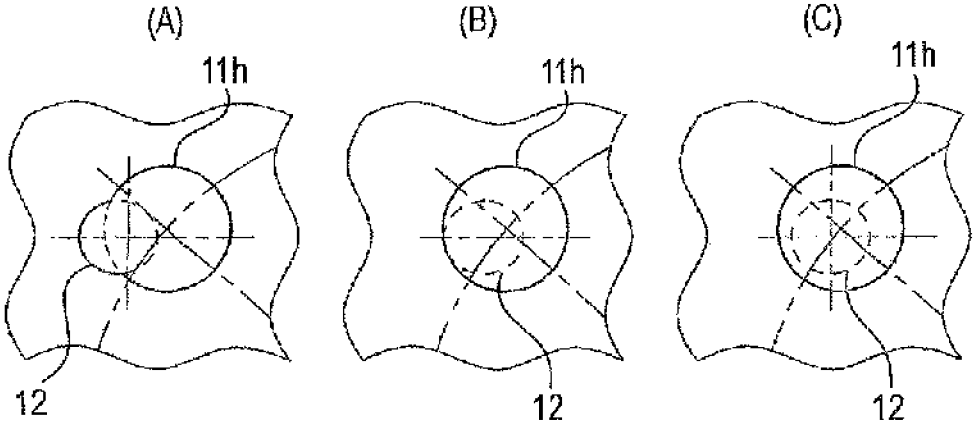
FIG. 3A is a sectional view taken along a line E-E of FIG. 3.
Figure 3B:
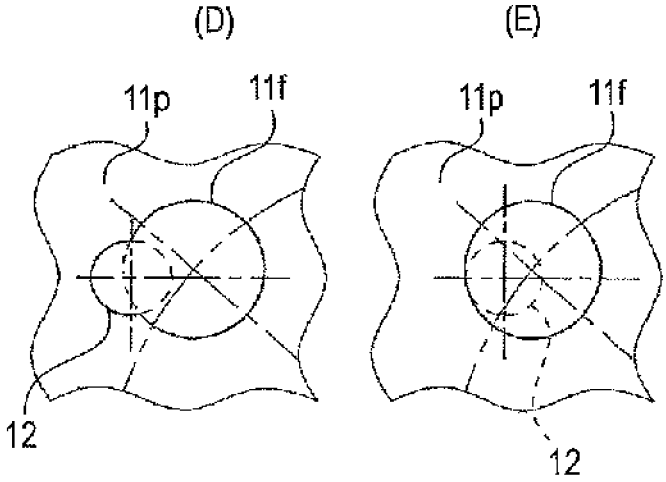
FIG. 3B is a sectional view taken along a line F-F of FIG. 3.

FIG. 3 is an enlarged sectional view of the injection hole portion of the fuel injection valve, FIG. 3A is an enlarged sectional view taken along a line E-E of FIG. 3, and FIG. 3B is similarly is an enlarged sectional view taken along a line F-F of FIG. 3. The relationship between an injection hole 12 and a plate concave 11*f* is variously considered. In the figure (A) of FIG. 3A, on the top surface 11*h* of the plate concave 11*f*, a portion of the injection hole 12 is opened to a top surface 11*h* of the plate concave 11*f*.

Thereby, since a liquid film which swirls within the injection hole 12 while being pushed against the injection hole inner wall 12*a* is elongated into thinner liquid film at the plate concave 11*f* having a larger internal diameter than the diameter of the injection hole, the flow velocity of the swirling flow decreases. Therefore, not only the fuel injected from an injection hole plate outlet 12*c* is injected as a hollow conical spray to promote atomization, but also the angle of spray can be kept from being excessively widened even when the injected fuel spreads with a centrifugal force.

Additionally, as shown in the figure (B), on the top surface 11*h* of the plate concave 11*f*, the top surface 11*h* of the plate concave and the injection hole 12 may internally touch each other, and as shown in the figure (C), on the top surface 11*h* of the plate concave 11*f*, the whole injection hole 12 may be opened to the top surface 11*h* of the plate concave.

Additionally, as shown in the figure (D) of FIG. 3B, on an downstream flat surface lip of the injection hole plate 11*f*, a portion of the injection hole 12 is opened to the downstream flat surface lip of the injection hole plate 11*f*.

Since this allows a portion of the injection hole inner wall 12*a* continue to the injection hole plate outlet 12*c*, directivity can be given by a liquid film which swirls within the injection hole 12, and it is possible to achieve the balance between the directivity and atomization of the spray of the fuel injected from the injection hole plate outlet 12*c*.

Additionally, as shown in the figure (E), on the downstream flat surface 11*p* of the injection hole plate, the injection hole 12 and the plate concave 11*f* may internally touch each other.

As described above, in the present invention, a fuel is accelerated when the fuel passes through a narrow flow passage between plate convexes. Therefore, there is an advantage that a hollow liquid film to be sprayed can be made thinner as the swirling speed in an injection hole increases and the fuel swirls sufficiently within the injection hole.

One imaginary cylinder 15*e*, which formed by a circle 15*c* having the axial center of the fuel injection valve as a center, and a cavity height 15*d*, is arranged within a flow passage radially outside the valve seat opening portion 10*b*, which is formed by the injection hole plate 11, the cavity 15, and the plate convex 11*e* (refer to a detailed portion C of FIG. 2), and the minimum fuel passage area at a side portion of the imaginary cylinder 15*e* when the diameter of the circle 15*c* is increased to the cavity inner wall 15*a* from the valve seat opening portion 10*b* is defined as a flow passage minimum area S1.

Figure 4:
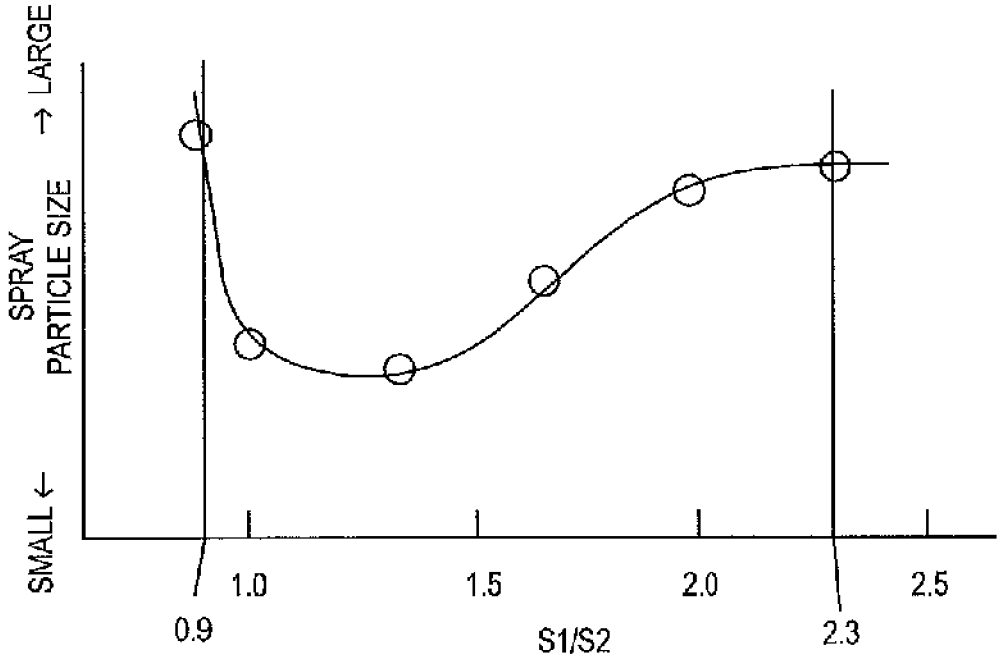
FIG. 4 is a chart showing results obtained by performing an experiment on the influence the relationship between the flow passage minimum area within a cavity of Embodiment 1 and a total of the opening area of individual injection holes formed radially outside a valve seat opening portion has on spray particle size.

FIG. 4 is a chart showing results obtained by performing an experiment on the influence the relationship between the flow passage minimum area S1 within the cavity of Embodiment 1 and a total S2 of the minimum sectional area 12*b* (refer to a D-D sectional view of FIG. 2) of individual injection holes formed radially outside the valve seat opening portion has on the spray particle size.

According to these experimental results, when a plate convex becomes small and the value of S1 becomes large, the acceleration of fuel between plate convexes becomes insufficient. As a result, the fuel cannot swirl around an injection hole sufficiently, and the liquid film can be made thinner.

On the contrary, when a plate convex becomes large and the value of S1 becomes small, the fuel is accelerated between projections. However, when the flow passage minimum area becomes small so as to be $S1/S2<1$, energy loss will increase due to an increase in flow velocity at the S1 portion. Therefore, it can be seen that sufficient atomization becomes impossible at the injection hole portion, and the spray particle size deteriorates.

That is, as shown in FIG. 4, there is a tendency that an atomization promotion effect is no longer seen at $S1/S2\geq2.3$ when S1 has been made large, and the particle diameter at $S1/S2\leq0.9$ deteriorates more than the spray particle size at $S1/S2\geq2.3$ when S1 has been made small. Therefore, it can be seen that the value of S1/S2 can be specified to a range of $0.9<(S1/S2)<2.3$, as a range obtained where the atomization effect by the swirling flow in the invention is obtained.

As described above, by setting the ratio of the flow passage minimum area S1 within the cavity, and the total S2 of the minimum sectional area 12*b* of the individual injection holes formed radially outside the valve seat opening portion 10*b* so as to satisfy the relationship of $0.9<(S1/S2)<2.3$ as shown in FIG. 4, the fuel flows into the injection hole 12 while the fuel flow 16*b* within the cavity is maintained at a fast flow velocity, it is possible to generate a good swirling flow to promote atomization.

In addition, although the above embodiment has been described that the cavity 15 through which the valve seat opening portion and the injection holes communicate with each other is provided in the downstream end surface 10*d* of the valve seat 10 so as to hollow out the valve seat 10. However, the cavity may be provided in the upstream flat surface 11*c* of the injection hole plate 11 so as to hollow out the injection hole plate. This is the also same in the following embodiments.

Embodiment 2

Figure 5:
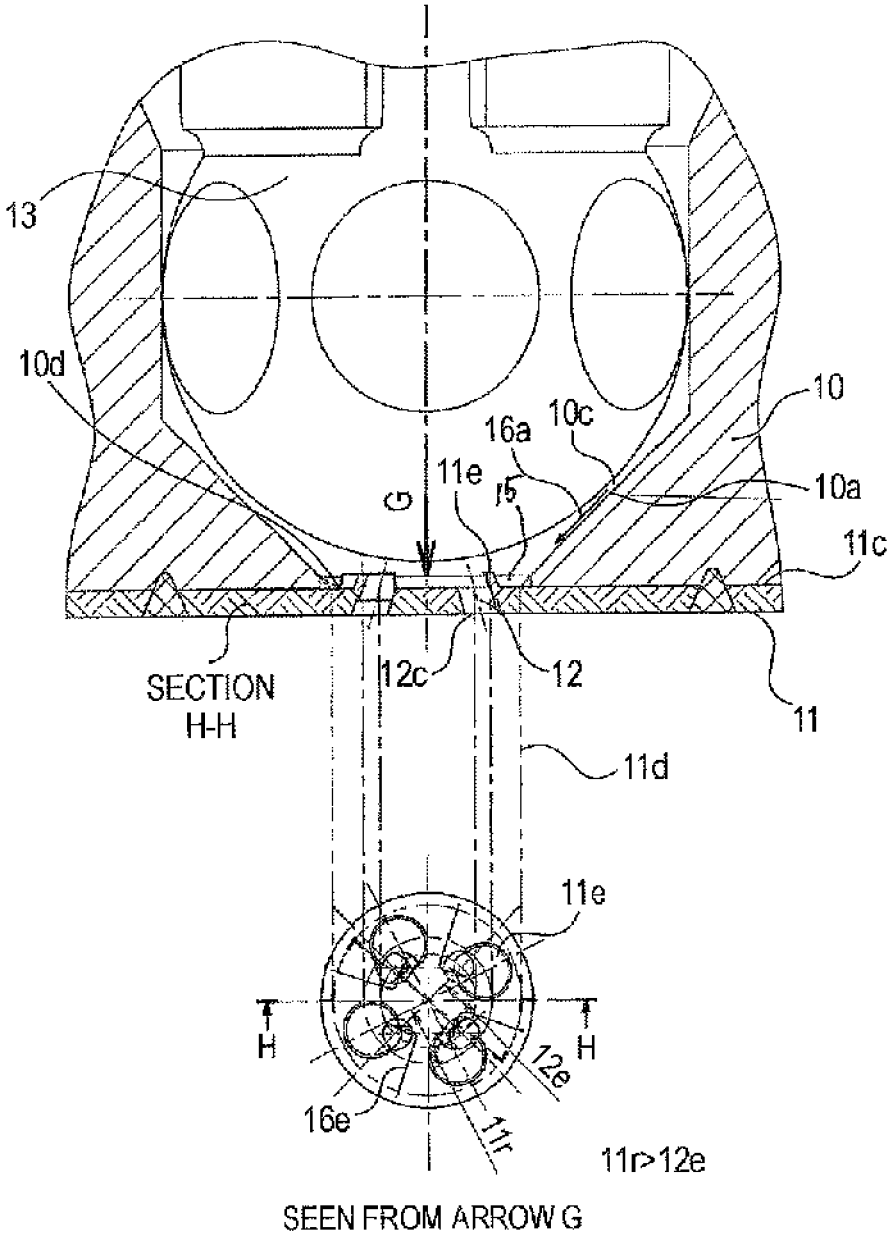
FIG. 5 is a view showing a detailed cross-section of a tip portion of a fuel injection valve of Embodiment 2.

A sectional view of a fuel injection valve of Embodiment 2 is shown in FIG. 5. In the present embodiment, the injection hole plate 11 is arranged so that an extension of the seat surface of the valve seat 10 which is reduced in diameter to the downstream side and the upstream flat surface 11*c* of the injection hole plate intersect each other to form one imaginary circle 11*d*, the cavity 15 is not provided in the downstream end surface 10*d* of the valve seat 10, and the injection holes 12 are formed radially inside the imaginary circle lid in the injection hole plate 11, and the plate convexes 11*e* are arranged radially inside the imaginary circle 11*d*.

Additionally, on the upstream flat surface 11*c* of the injection hole plate 11, the injection hole 12 and the plate convex 11*e* which straddles the injection hole 12 are arranged so that the distance 11*r* from the axial center of the fuel injection valve to the center of the plate convex 11*e* becomes longer than the distance 12*e* from the axial center of the fuel injection valve to the center of the injection hole 12. The other configurations are the same as those of Embodiment 1.

Thereby, when the valve body is opened, the fuel flow 16*a* from the gap 10*c* between the valve body tip portion 13 and the valve seat surface 10*a* swirls around the plate convex 11*e* formed radially inside the imaginary circle 11*d* toward the radial inside of the axial center of the fuel injection valve, and flows into the injection hole 12, whereby a swirling flow 16*e* is generated. Therefore, the swirling flow 16*e* is strengthened. Thereby, since the fuel is injected as a hollow conical spray from the injection hole outlet 12*c*, it is possible to promote atomization.

Embodiment 3

Figure 6:
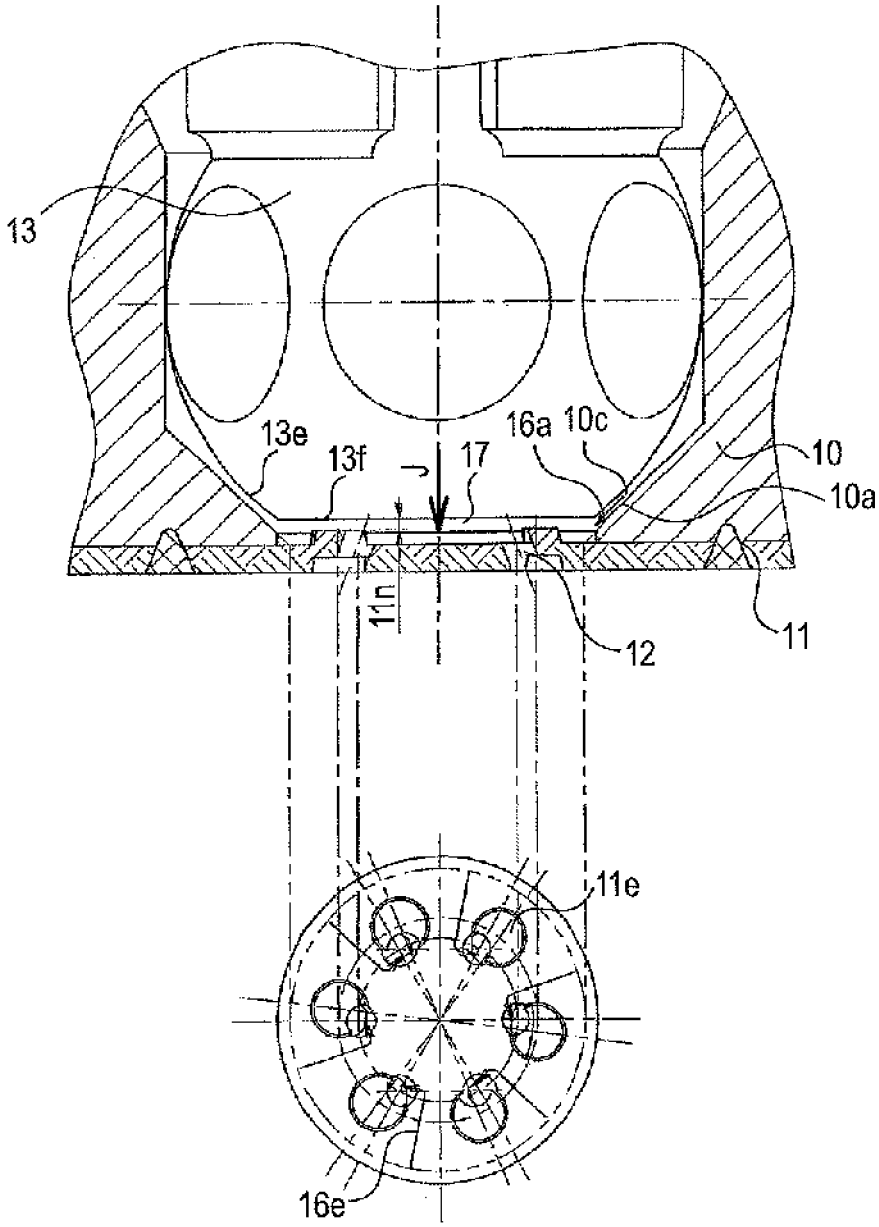
FIG. 6 is a view showing a detailed cross-section of a tip portion of a fuel injection valve of Embodiment 3.

A sectional view of a fuel injection valve of Embodiment 3 is shown in FIG. 6. As shown in the drawing, the fuel injection device is structured so as to reduce each injection hole 12 and the vertical height 11*n* of the plate convex 11*e* and reduce the dead volume 17 by providing a flat surface portion 13*f*, which becomes substantially parallel to the injection hole plate 11, downstream of the sheet portion 13*e* of the valve body tip portion 13. The other configurations are the same as those of Embodiment 2.

Thereby, when the valve body is closed, the amount of fuel evaporation under high-temperature negative pressure is low, and changes in flow characteristics (a static flow rate and a dynamic flow rate) accompanying an ambient pressure change can be suppressed. Additionally, when the valve body is opened, the fuel flow 16*a* which is directed to the radial inside from the axial center of the fuel injection valve from the gap 10*c* between the valve body tip portion 13 and the valve seat surface 10*a* is strengthened. Therefore, it is possible to further strengthen the swirling flow 16*e* and to promote atomization.

Embodiment 4

Figure 7:
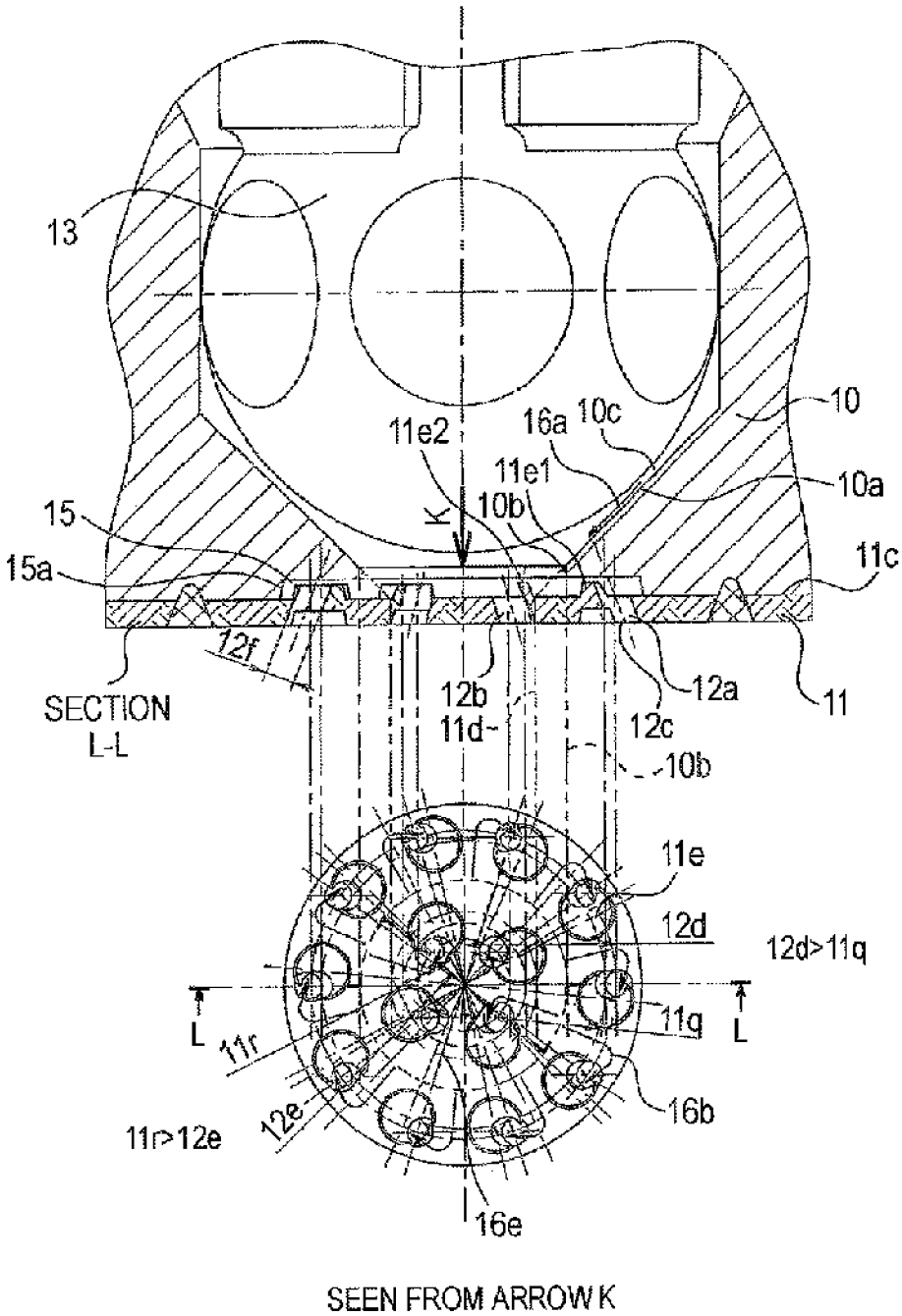
FIG. 7 is a view showing a detailed cross-section of a tip portion of a fuel injection valve of Embodiment 4.

A sectional view of a fuel injection valve of Embodiment 4 is shown in FIG. 7. In the present embodiment, the injection hole plate 11 is arranged so that an extension of the seat surface of the valve seat 10 which is reduced in diameter to the downstream side and the upstream flat surface 11*c* of the injection hole plate 11 intersect each other to form one imaginary circle 11*d*. In the injection hole plate 11, injection holes 12*a* are arranged radially outside the valve seat opening portion 10*b*, and injection holes 12*b* are radially inside the imaginary circle 11*d*, plate convexes 11*e*1 corresponding to the injection holes 12*a* formed radially outside the valve seat opening portion 10*b* are arranged radially outside than the valve seat opening portion 10*b* and radially inside the cavity inner wall 15*a*, and plate convexes 11*e*2 corresponding to the injection holes 12*b* formed radially inside the imaginary circle 11*d* are arranged radially inside the imaginary circle 11*d*.

Additionally, on the upstream flat surface 11*c* of the injection hole plate 11, the injection hole 12 and the plate convex 11*e* which straddles the injection hole 12 are arranged so that the distance 11*q* from the axial center of the fuel injection valve to the center of the plate convex 11*e*1 becomes shorter than the distance 12*d* from the axial center of the fuel injection valve to the center of the injection hole 12*a*, radially outside the valve seat opening portion 10*b*, and a distance 11*r* from the axial center of the fuel injection valve to the center of the plate convex 11*e*1 becomes longer than the distance 12*e*2 from the axial center of the fuel injection valve to the center of the injection hole 12*b*, radially inside the imaginary circle 11*d*. The other configurations are the same as those of Embodiment 1.

Thereby, when the valve body is opened, a fuel flow 16*a* from the gap 10*c* between the valve body tip portion 13 and the valve seat surface 10*a* passes through the valve seat opening portion 10*b*, and spreads radially outward from the axial center of the fuel injection valve along the shape of the cavity 15. Thereafter, as the fuel flow swirls around the plate convex 11*e*1 formed radially outside the valve seat opening portion 10*b*, and flows into the injection hole 12*a*, a swirling flow 16*b* is generated. Additionally, a fuel flow, which does not run along the shape of the cavity 15 but is directed to the radial inside from the axial center of the fuel injection valve by the shape of the seat surface of the valve seat 10 which is reduced in diameter to the downstream side, swirls around the plate convex 11*e*2 formed radially inside the imaginary circle 11*d*, and flows into the injection hole 12*b*, whereby a swirling flow 16*e* is generated. In the present embodiment, the injection hole diameter 12*f* per one injection hole can be made smaller compared to Embodiments 1 and 2 by increasing the number of the injection hole 12. Thereby, not only a liquid film within the injection hole 12 can be made small, but the flow velocity of a swirling flow within the injection hole 12 increases. Therefore, it is able to promote atomization of a hollow conical spray injected from the injection hole outlet 12*c*.

Embodiment 5

Figure 8:
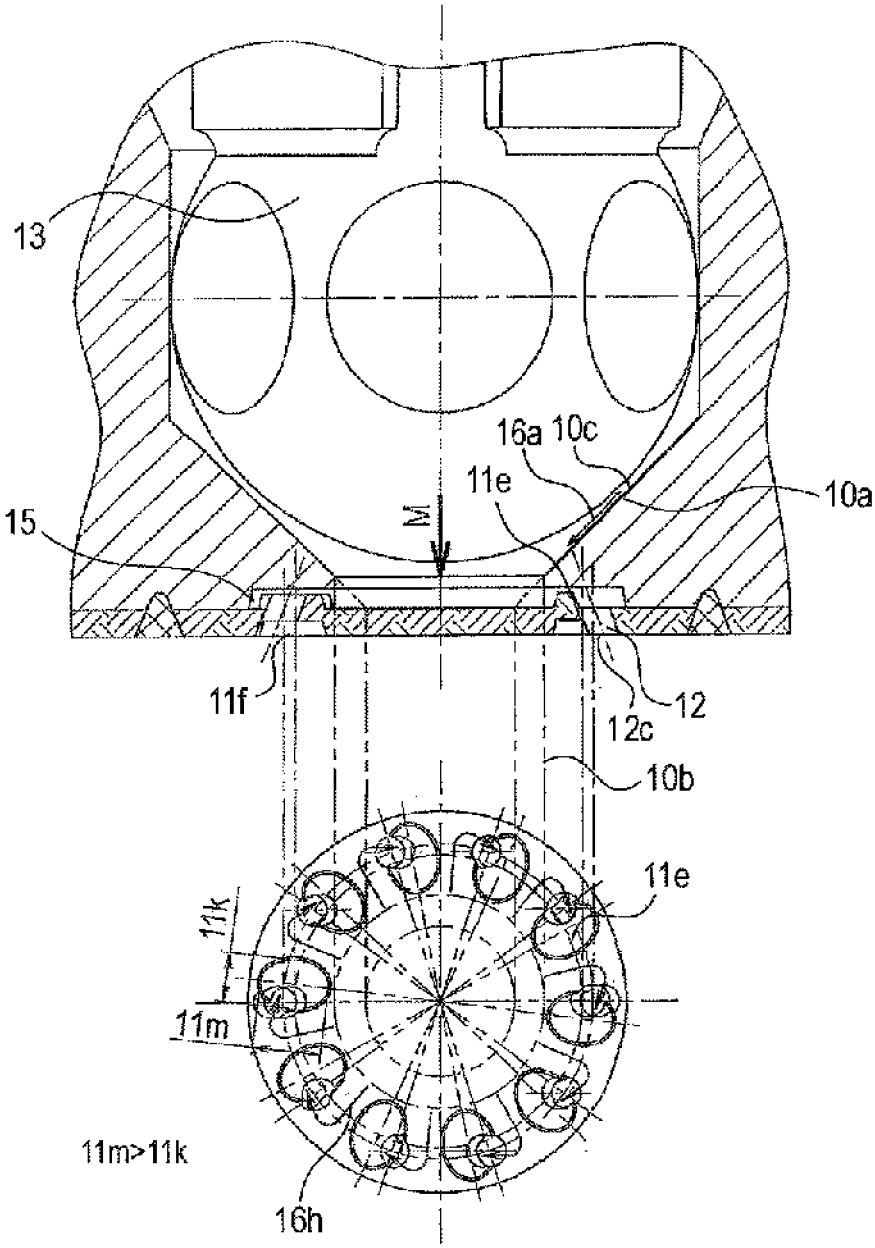
FIG. 8 is a view showing a detailed cross-section of a tip portion of a fuel injection valve of Embodiment 5.

A sectional view of a fuel injection valve of Embodiment 5 is shown in FIG. 8. In the present embodiment, the plate convex 11*e* and the plate concave 11*f* are formed so that a radial axis length 11*m* becomes longer than a circumferential axis length 11*k* with respect to the axial center of the fuel injection valve. The other configurations are the same as those of Embodiment 1.

Thereby, when the valve body is opened, a fuel flow 16*a* from the gap 10*c* between the valve body tip portion 13 and the valve seat surface 10*a* passes through the valve seat opening portion 10*b*, and spreads radially outward from the axial center of the fuel injection valve along the shape of the cavity 15. Since the plate convex 11*e* has a shape that the radial axis length 11*m* is longer than the circumferential axis length 11*k* with respect to the axial center of the fuel injection valve, a fuel flow 16*h* which swirls around the plate convex 11*e* is rectified and accelerated, and flows into the injection hole 12, a swirling flow within the injection hole 12 is further strengthened. Thereby, since the fuel is injected as a hollow conical spray from the injection hole outlet 12*c*, it is possible to promote atomization.

Embodiment 6

Figure 9:
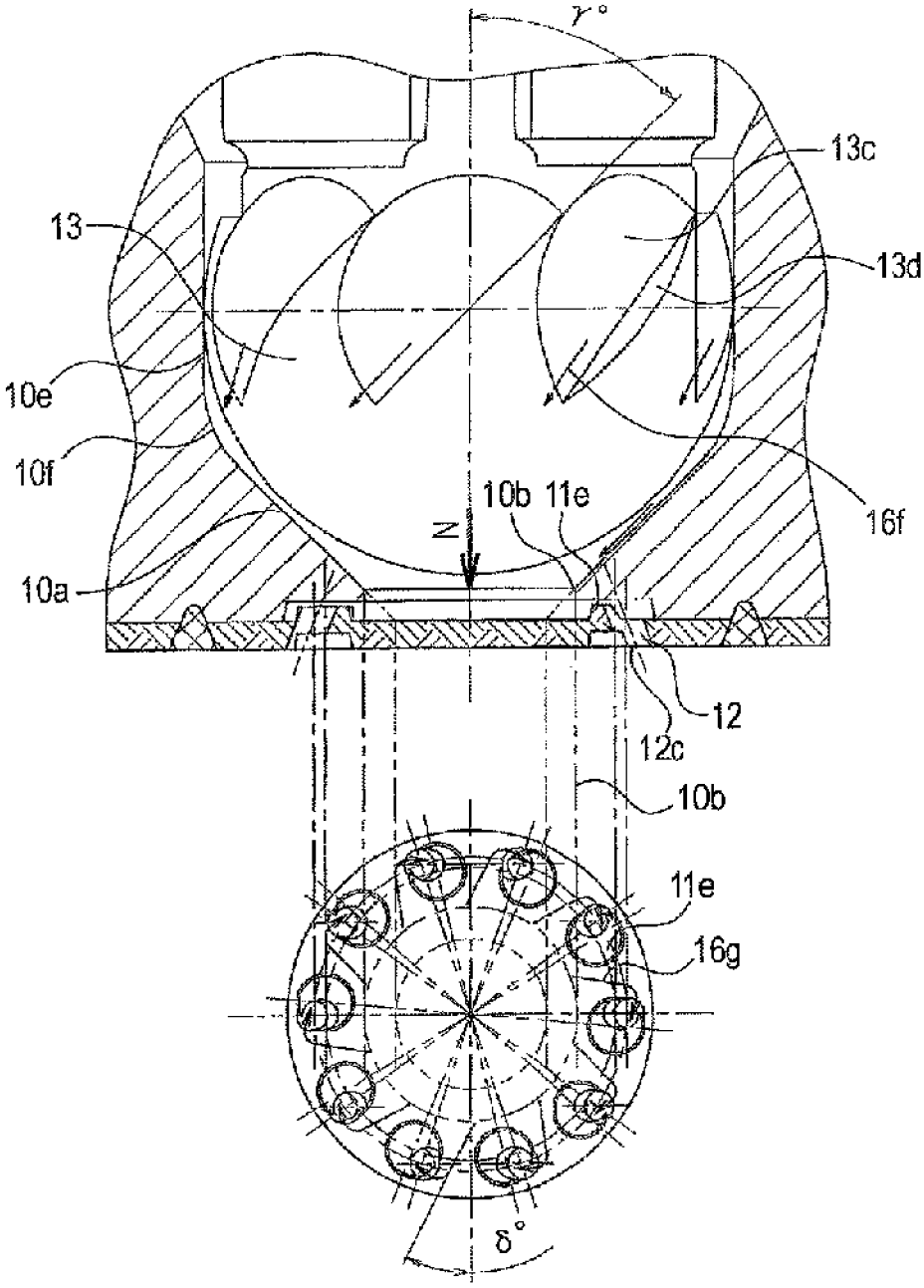
FIG. 9 is a view showing a detailed cross-section of a tip portion of a fuel injection valve of Embodiment 6.

A sectional view of a fuel injection valve of Embodiment 6 is shown in FIG. 9. In the present embodiment, a plurality of substantially semicircular flat surface 13*c* is formed at a ball outer circumferential portion of the valve body tip portion 13, and another other flat surfaces 13*d* which intersects each of the semicircular flat surfaces is provided so as to incline at a predetermined angle $\gamma°$ with respect to the axial center of the fuel injection valve, forming a swirling groove used as a fuel passage, whereby a swirling flow 16*f* is formed. The other configurations are the same as those of Embodiment 1.

Thereby, since the fuel flow 16*g* inclines at $\sigma°$ with respect to a radial direction, swirls around the plate convex 11*e* formed radially outside the valve seat opening portion 10*b*, and flows into the injection hole 12, a swirling flow in the injection hole 12 is further strengthened. Thereby, since the fuel is injected as a hollow conical spray from the injection hole outlet 12*c*, it is possible to promote atomization.

Additionally, there is an effect of maintaining a swirling flow caused by the swirling groove by forming a connecting portion between the seat surface 10*a* of the valve seat, and the guide portion 10*e* in a rounded (R) shape 10*f*.

Figure 10A:
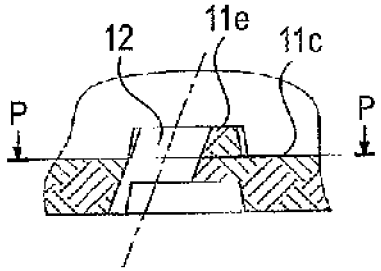
FIG. 10 is a chart showing results obtained by performing an experiment on the influence the relationship between a plate convex and an injection hole has on spray particle size.
Figure 10B:
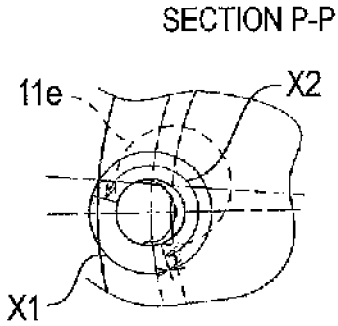

FIG. 10 is a chart showing results obtained by performing an experiment on the influence the relationship between a plate convex 11*e* and an injection hole 12 has on spray particle size, in the above-described embodiment. In FIGS. 10A and 10B, respective dimensions in the upstream flat surface 11*c* of the injection hole plate 11 are defined as follows.

Circumferential length of the injection hole 12: x1

Circumferential length of the injection hole 12 which the plate convex 11*e* straddles: x2

Figure 10C:
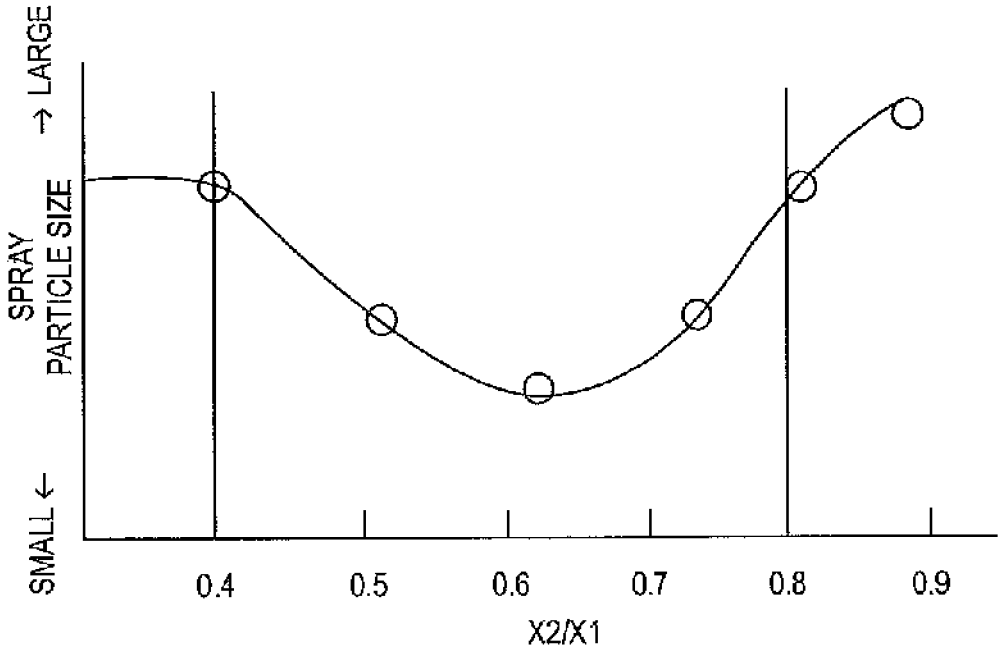

In the above definitions, in order to generate a good swirling flow and promote atomization from experimental results, it can be seen from the experimental results of FIG. 10C that the ratio (x2/x1) at which the plate convex 11*e* straddles the injection hole 12 becomes $$0.4<(x2/x1)<0.8.$$

In addition, by forming the plate convexes 11*e* and the plate concaves 11*f* in a substantially circular shape in the above various embodiments, it is possible to suppress fuel spray variation with easy working at low manufacturing cost.

Additionally, if the injection hole plate convexes 11*e* and the plate concaves 11*f* are simultaneously formed by a press when an injection hole plate is fabricated, positional accuracy of the plate convexes 11*e*, the plate concaves 11*f*, and the injection holes 12 is easily secured, and it is possible to suppress fuel spray variation with easy working at low manufacturing cost.

Various modifications and alterations of this invention will be apparent to those skilled in the art without departing from the scope and spirit of this invention, and it should be understood that this is not limited to the illustrative embodiments set forth herein.

What is claimed is:

1. A fuel injection valve having a valve body for opening and closing a valve seat, and receiving an actuating signal from a control device to actuate the valve body, thereby injecting fuel from a plurality of injection holes provided in an injection hole plate mounted on the downstream side of the valve seat after passing through between the valve body and valve seat surface, wherein a plate convex is formed on the upstream side of the injection hole plate and a plate concave is formed on the downstream side of the injection hole plate so as to form a pair together, at least one set of the pair of the plate convex and the plate concave is formed, and the injection holes are arranged so that a radial centerline which connects the centerline of the plate convex from the axial center of the fuel injection valve does not overlap the center of the injection hole on an upstream flat surface of the injection hole plate, and wherein the plate convex is arranged on the upstream flat surface of the injection hole plate so that a portion of the injection hole is opened on both the upstream flat surface of the injection hole plate, and the plate convex top surface.

2. The fuel injection valve according to claim 1, wherein the injection holes are formed radially outside a valve seat opening portion in the injection hole plate, and a cavity through which the valve seat opening portion and the injection holes communicate with each other is provided in any one of a downstream end surface of the valve seat, and an upstream flat surface of the injection hole plate.

3. The fuel injection valve according to claim 1, wherein, on an upstream flat surface of the injection hole plate, the injection hole and the plate convex which straddles the injection hole are arranged so that the distance from the axial center of the fuel injection valve to the center of the plate convex becomes shorter than the distance from the axial center of the fuel injection valve to the center of the injection hole.

4. The fuel injection valve according to claim 1, wherein the injection hole plate is arranged so that an extension of the seat surface of the valve seat which is reduced in diameter to the downstream side and the upstream flat surface of the injection hole plate intersect each other to form one imaginary circle, and the injection holes are formed radially inside the imaginary circle in the injection hole plate.

5. The fuel injection valve according to claim 4, wherein, on the upstream flat surface of the injection hole plate, the injection hole and the plate convex which straddles the injection hole are arranged so that the distance from the axial center of the fuel injection valve to the center of the plate convex becomes longer than the distance from the axial center of the fuel injection valve to the center of the injection hole.

6. The fuel injection valve according to claim 4, wherein a flat surface portion which becomes substantially parallel to the injection hole plate is provided downstream of a sheet portion of the valve body tip portion.

7. The fuel injection valve according to claim 1, wherein the injection hole plate is arranged so that an extension of the seat surface of the valve seat which is reduced in diameter to the downstream side and the upstream flat surface of the injection hole plate intersect each other to form one imaginary circle, the injection holes are formed radially outside the valve seat opening portion and radially inside the imaginary circle in the injection hole plate, and a cavity through which the valve seat opening portion and the injection holes formed radially outside the valve seat opening portion communicate with each other is provided in any one of a downstream end surface of the valve seat, and an upstream end surface of the injection hole plate.

8. The fuel injection valve according to claim 7, wherein, on an upstream flat surface of the injection hole plate, the injection hole and the plate convex which straddles the injection hole are arranged so that the distance from the axial center of the fuel injection valve to the center of the plate convex becomes shorter than the distance from the axial center of the fuel injection valve to the center of the injection hole radially outside the valve seat opening portion, and the distance from the axial center of the fuel injection valve to the center of the plate convex becomes longer than the distance from the axial center of the fuel injection valve to the center of the injection hole radially inside the imaginary circle.

9. The fuel injection valve according to claim 2, wherein when the flow passage minimum area within the cavity is defined as S1, and the total of the opening area of the individual injection holes formed radially outside the valve seat opening portion is defined as S2, the ratio (S1/S2) of the flow passage minimum area within the cavity, and the total of the opening area of the individual injection holes is $0.9<(S1/S2)<2.3$.

10. The fuel injection valve according to claim 7, wherein when the flow passage minimum area within the cavity is defined as S1, and the total of the opening area of the individual injection holes formed radially outside the valve seat opening portion is defined as S2, the ratio (S1/S2) of the flow passage minimum area within the cavity, and the total of the opening area of the individual injection holes is $0.9<(S1/S2)<2.3$.

11. The fuel injection valve according to claim 1, wherein the plate convex and the plate concave are formed so that the radial axis length is longer than a circumferential axis length with respect to the axial center of the fuel injection valve.

12. The fuel injection valve according to claim 1, wherein the plate convex and the plate concave are substantially circular.

13. The fuel injection valve according to claim 1, wherein at the valve body of a guide portion provided upstream of the seat surface of the valve seat in order to guide the valve guide, a plurality of grooves to be fuel passages is formed on the circumference while being inclined at a predetermined angle with respect to the axis of the valve body so as to be swirling grooves.

14. The fuel injection valve according to claim 13, wherein a connecting portion of the seat surface between the valve body tip portion and the guide portion is formed in a rounded shape in the valve seat.

15. The fuel injection valve according to claim 1, wherein a portion or whole of the injection hole is opened to the top surface of the plate concave on the top surface of the plate concave.

16. The fuel injection valve according to claim 1, wherein on the downstream flat surface of the injection hole plate, a portion of the injection hole is opened to the downstream flat surface of the injection hole plate, or the injection hole internally touches the plate concave.

17. The fuel injection valve accordingly to claim 1, wherein when the circumferential length of the injection hole is defined as x1, and the circumferential length of the injection hole that the plate convex straddles is defined as x2, on the upstream flat surface of the injection hole plate, the ratio (x2/x1) at which the injection hole straddles the plate convex is $0.4<(x2/x1)<0.8$.

18. The fuel injection valve according to claim 1, wherein the plate convex and the plate concave are simultaneously formed by a press.

* * * * *